US005141663A

United States Patent [19]

Miller

[11] Patent Number: 5,141,663

[45] Date of Patent: Aug. 25, 1992

[54] FIRE RESISTANT HYDRAULIC FLUID COMPOSITION

[75] Inventor: Philip R. Miller, Hamden, Conn.

[73] Assignee: Olin Corporation, Cheshire, Conn.

[21] Appl. No.: 632,874

[22] Filed: Dec. 24, 1990

Related U.S. Application Data

[63] Continuation-in-part of Ser. No. 576,301, Aug. 31, 1990.

[51] Int. Cl.[5] ..... C10M 169/04; C10M 107/34; C10N 40/00

[52] U.S. Cl. ..... 252/79; 252/52 A; 252/56 R; 252/73

[58] Field of Search ..... 252/79, 76, 73, 56 R, 252/52 A

[56] References Cited

U.S. PATENT DOCUMENTS

| | | | |
|---|---|---|---|
| 2,499,723 | 3/1950 | Coffman et al. | 252/56 S |
| 3,254,063 | 5/1966 | Ilnyckyj | 260/87.3 |
| 3,567,639 | 3/1971 | Aaron et al | 252/56 R |
| 3,591,502 | 7/1971 | Ilnyckyj et al. | 252/52 R |
| 3,981,850 | 9/1976 | Wisotsky et al. | 252/56 R |
| 4,234,497 | 11/1980 | Honig | 260/410.6 |
| 4,263,159 | 4/1981 | Berens et al. | 252/79 |
| 4,645,615 | 2/1987 | Drake | 252/78.5 |

FOREIGN PATENT DOCUMENTS 359071 3/1990 European Pat. Off. .

OTHER PUBLICATIONS

Smalheer et al, "Lubricant Additives", pp. 7-8, 1967.

*Primary Examiner*—Paul Lieberman
*Assistant Examiner*—Christine A. Skane
*Attorney, Agent, or Firm*—William A. Simons; Dale L. Carlson

[57] ABSTRACT

The present invention relates to a hydraulic fluid composition comprising: (a) a base fluid and (b) as an anti-mist additive, an alkylene-vinyl ester copolymer having a molecular weight of between about 5,000 and about 100,000 and soluble in said base fluid. In another aspect, the present invention relates to a process for imparting flame retardancy and reduced wear characteristics to a hydraulic system which comprises adding to the hydraulic system the above-identified hydraulic fluid composition.

4 Claims, No Drawings

FIRE RESISTANT HYDRAULIC FLUID COMPOSITION

This is a continuation-in-part application of U.S. Ser. No. 07/576,301, filed Aug. 31, 1990, now pending.

FIELD OF THE INVENTION

This invention relates generally to hydraulic fluid compositions and, more specifically, to hydraulic fluids characterized by enhanced fire resistance.

BACKGROUND OF THE INVENTION

In the past, polyalkylene glycol-based hydraulic fluids have generally required the presence of water therein in order to provide a degree of fire resistance sufficient to meet the Factory Mutual Research, Group I, Class No. 6930 approval (so-called "FM approval") with regard to the flame resistance of the fluid. Water is undesirable as an additive in hydraulic fluids for several reasons, most notably due to operating pressure limitations imparted by the vapor pressure of water and potential corrosion problems caused by water on the metal surfaces of the hydraulic system.

As an alternative to the use of water additives in polyalkylene glycol-based hydraulic fluids, polyol ester-type fluids, e.g. trioleate esters of trimethylol propane, typically utilize high molecular weight polymer anti-mist additives in order to provide FM approval. Unfortunately, such anti-mist additives tend to degrade when subjected to the shear forces typically encountered by hydraulic fluids during use. Accordingly, hydraulic fluids containing such prior art anti-mist additives tend to have relatively short useful lives of a few months or less, dependant upon the operating conditions and service requirement for the particular application for which the hydraulic fluid is employed. Additionally, polyol ester type lubricant bases are also subject to hydrolysis under certain conditions, which can alter the performance characteristics of the hydraulic fluid.

In view of the above, new non-aqueous hydraulic fluids that exhibit an improved combination of flame retardancy and shear stability would be highly desired by the hydraulic fluid manufacturing community.

SUMMARY OF THE INVENTION

In one aspect, the present invention relates to a hydraulic fluid composition comprising:

(a) a synthetic base fluid having a flash point of at least 400° F. selected from the group consisting of esters, diesters, polyol esters, polyalkylene glycol esters, polyalkylene glycols, and combinations thereof, and (b) as an anti-mist additive, an alkylene-vinyl ester copolymer having a molecular weight of between about 5,000 and about 100,000 (preferably 10,000-50,000) and soluble in said base fluid.

In another aspect, the present invention relates to a process for imparting flame retardancy, hydrolytic stability, and reduced wear characteristics to a hydraulic system which comprises adding to the hydraulic system a hydraulic fluid composition comprising:

(a) a synthetic base fluid having a flash point of at least 400° F. selected from the group consisting of esters, diesters, polyol esters, polyalkylene glycol esters and polyalkylene glycols, and combinations thereof, and (b) as an anti-mist additive, an alkylene-vinyl ester copolymer having a molecular weight of between about 5,000 and about 100,000 and soluble in said base fluid.

These and other aspects will become apparent upon reading the following detailed description of the invention.

DETAILED DESCRIPTION OF THE INVENTION

In accordance with the present invention, it has now been surprisingly found that a hydraulic fluid composition can be provided that provides excellent anti-wear properties as well as enhanced flame retardancy over time during use. The hydraulic fluid is polyalkylene glycol based and contains an anti-mist additive exhibiting an improved shear-stable characteristic relative to those utilized in polyol ester type hydraulic fluids.

The polyalkylene glycols useful as the base fluid in the hydraulic fluids of the present invention are generally anionically or cationically catalyzed using, for example, an alkali metal salt of a lower alkanol initiator. An illustrative example is a potassium hydroxide catalyzed butanol initiated polypropylene glycol. The various polyalkylene glycols, including monols, diols, triols, and the like, are well-known in the art and are commercially available, for example, under various trademarks, including Olin Corporation's POLY-G trademark, Union Carbide Corporation's UCON trademark, and BASF Corporation's PLURACOL trademark.

The preferred anti-mist additive useful in the present invention is an alkylene-vinyl ester copolymer having a molecular weight of between about 5,000 and about 100,000, wherein the alkylene compound is preferably selected from the group consisting of ethylene, propylene, butylene, and combinations thereof. The copolymer can be a random or block-type copolymer with the ratio of alkylene groups to vinyl ester groups in the copolymer being between about 1:10 and about 10:1 with the proviso that the copolymer be soluble in the base fluid. The most preferred copolymer is an ethylene-vinyl ester copolymer commercially available as V-152, a product of Functional Products Corporation of Cleveland, Ohio. The copolymer is suitably prepared using known techniques for ethylene-vinyl ester copolymerizations as disclosed, for example, in U.S. Pat. Nos. 3,254,063 and 3,591,502, both incorporated herein by reference in their entirety.

Illustratively, the alkylene-vinyl ester copolymer is suitably prepared by copolymerizing the alkylene compound (e.g., ethylene, propylene, butylene, or combinations thereof) with a copolymerizable unsaturated ketone. Suitable ketones include, for example vinyl methyl ketone, vinyl n-octyl ketone, vinyl-isooctyl ketone, vinyl dodecyl ketone, vinyl-cyclohexyl ketone, 3-pentene-2-one, and combinations thereof. The molar percent of alkylene compound to ketone is suitably between 5 and 80 percent based upon the total amount of alkylene compound plus ketone employed to produce the copolymer.

The amount of anti-mist additive in the hydraulic fluid of the present invention is preferably between about 0.1 and about 20 weight percent, and more preferably between about 0.5 and about 10 weight percent based upon the total amount of anti-mist additive plus base fluid in the hydraulic fluid.

The hydraulic fluid of the present invention is non-aqueous or "essentially water free" which is intended to designate that the hydraulic fluid contains no more than 5 weight percent water, preferably no more than 2 weight percent water, based upon the weight of the hydraulic fluid.

In compositions of this invention, it is essential that both the component (a) and the component (b) be present in order to provide the desired flame retardancy and anti-wear properties. Additional optional additives are also suitably employed as desired, including, for example, the functional fluids of this invention will normally contain very minor amounts, typically from about 0.01% to about 5.0% by weight of various additives of the type commonly incorporated in formulating hydraulic fluids and lubricants such as rust and oxidation inhibitors, corrosion inhibitors, metal passivators, antiwear agents and other special purpose additives.

Rust and corrosion inhibitors and metal passivators suitably employed include tolyltriazole, benzothiazole and benzotriazole and their derivatives, alkyl and aryl phosphites and sarcosine and succinic acid derivatives. Antioxidants include dialkylthiodiproprionate, for example, dilaurylthiodiproprionate etc. organic amines, for example, dioctyldiphenylamine, phenylnaphthylamine, hindered phenols, phenothiazine, etc. Antiwear additives include dithiophosphates, amine phosphates, organo-molybdenum compounds, phosphorothionates, carbamates, etc. The suitably of such optional additives will depend upon the operating conditions, and the service requirements for the particular application that the hydraulic fluid is employed in. Except for the requirements given above, the relative proportions of and the maximum amount of each of these components and the combination thereof that should be present is not critical to the present invention. Economic factors also help determine what optimum amounts should be used. If used, the optional additives are suitably employed in an amount up to about 40 weight percent base upon the total weight of the hydraulic fluid.

The hydraulic fluid composition of the present invention preferably has a viscosity of between about 15 and about 3000 centistokes at 40° C.

The following examples are intended to illustrate, but in no way limit the scope of, the present invention. All patents referred to herein are incorporated herein by reference in their entirety.

EXAMPLES 1-7

Preparation of Hydraulic Fluids and Testing Thereof

Hydraulic fluid compositions within the scope of the present invention are shown in Table I, Example Formulations. Comparative example formulations are shown in Table II. The listed components are added into a reaction vessel in random order and mixed thoroughly at a temperature of from 40° C. to 60° C. for at least ½ hour. All formulations are given in weight percent.

TABLE I

| | Example Formulations | | | | | | |
|---|---|---|---|---|---|---|---|
| Formulation Components | 1 | 2 | 3 | 4 | 5 | 6 | 7 |
| POLY-G ® WI-165[1] | 60.9 | | | | | 61.9 | |
| POLY-G ® WI-285 | 34.9 | 90.8 | 38.3 | | | 32.6 | |
| POLY-G ® WI-625 | | 5.7 | 57.5 | | | | |
| POLY-G ® WI-700D | | | | 96.8 | | | |
| POLY-G ® WI-200N | | | | | 96.8 | | |
| TMP-Oleic Acid Ester | | | | | | | 94.5 |
| Phenothiazine | 0.5 | 0.5 | 0.5 | 0.5 | | 0.5 | 0.5 |
| Dioctyldiphenylamine | | | | | 0.2 | | |
| Triphenylphosphorothionate | 0.5 | 0.5 | 0.5 | 0.5 | | 0.5 | 0.5 |
| Ciba Geigy Irgalube 349 | 0.2 | 0.5 | 0.2 | 0.2 | | 0.5 | 0.5 |
| V-152(ethylene-vinyl ester) | 3 | 2 | 3 | 2 | 3 | 4 | 4 |
| Iso Grade | 46 | 68 | 100 | 150 | 100 | 46 | 68 |
| Factory Mutual Result | P | P | P | P | P | P | NT |

| Base Fluid | Initiator | Molecular Weight | Flash Point (COC) |
|---|---|---|---|
| WI-165 | Butanol | 750 | 425° F. |
| WI-285 | Butanol | 1040 | 425° F. |
| WI-625 | Butanol | 1840 | 440° F. |
| WI-700D | Propylene Glycol | 2000 | 465° F. |
| WI-200N | Nonylphenol | 810 | 455° F. |
| TMP-Oleic Acid Ester | Trimethylol Propane | 970 | 590° F. |

P = Pass.
F = Fail.
NT = Not Tested
[1]POLY-G is a registered trademark of Olin Corporation.

TABLE II

| | Comparative Examples | | | |
|---|---|---|---|---|
| | Comparative Formulations | | | |
| Formulation Components | 1 | 2 | 3 | 4 |
| POLY-G ® WI-285 | 0 | 92.1 | 92.5 | 0 |
| POLY-G ® WI-625 | 0 | 5.6 | 5.7 | 0 |
| TMP-Oleic Acid Ester | 0 | 0 | 0 | 98 |
| POLY-G ® WI-200N | 99.8 | 0 | 0 | 0 |
| Phenothiazine | 0 | 0 | 0.5 | 0 |
| Dioctyldiphenylamine | 0.2 | 0 | 0 | 0.5 |
| Triphenylphosphorothionate | 0 | 0.5 | 0.5 | 0.5 |
| Ciba Geigy Irgalube 349 | 0 | 0.8 | 0.8 | 0.5 |
| V-152 (ethylene-vinyl ester) | 0 | 0 | 0 | 0 |
| Ciba Geigy Irganox L-57 | 0 | 0.5 | 0 | 0 |
| Ciba Geigy Irganox L-130 | 0 | 0.5 | 0 | 0.5 |
| Iso Grade | 100 | 68 | 100 | 68 |
| Factory Mutual Result | F | F | F | NT |

P = Pass.
F = Fail.
NT = Not Tested

A commercially available polyol ester hydraulic fluid was used as a comparison, namely Cosmolubric ® HF130 hydraulic fluid manufactured by E. F. Houghton Co. of Valley Forge, Pa.

The formulations were tested using a laboratory hydraulic fluid pump test in accordance with ASTM-D2882 in order to measure the extent of pump wear resulting from the use of a specific fluid. Briefly, this test is conducted as follows:

Five gallons of a hydraulic fluid are circulated through a rotary vane pump system for 100 hours at a pump speed of 1200±60 rpm and a pump outlet pressure of 2000±40 psi. Fluid temperature at the pump inlet is 150±5° F. The result obtained is the total cam ring and vane (12) weight losses during the test.

The results of several pump wear tests ranged from 0.1 mg to 10.0 mg, indicating that this fluid is a premium performance hydraulic fluid. In comparison, the polyol ester hydraulic fluid wear amount ranged from 2.0–15 mg of weight loss during the 100 hour wear test.

The hydraulic fluids were also tested for fire resistance in accordance with the test procedure of Factory Mutual Research, Group II, Class No. 6930. Briefly, this test was conducted as follows:

A sample of fluid is heated to 140° F. in a steel container, then pressurized to 1000 psig with nitrogen. The sample is discharged into an open space from a 80° hollow cone HAGO oil burner nozzle rated for 1.5 gal/hr at 100 psig. This apparatus is used for both the flame propagation and hot surface tests described below:

Flame Propagation test - A propane torch is introduced into an atomized spray for each fluid at points of 6 inches and 18 inches from the nozzle tip. Ten attempts at ignition are made at each distance and any resulting fluid ignition is timed. Ignition lasting more than 5 seconds for any one of the ten attempts is considered a failure.

Hot Surface Ignition Test - A steel channel iron inclined 30° from the horizontal and equipped with side heat shields is heated from below by two propane-air burners to 1300° F. The burners are turned off, then fluid is discharged for 60 seconds at a distance of 6 inches. The fluid can pass if ignition occurs, but the flame must not follow the spray when directed away from the hot surface.

The results of the fire resistance testing indicated that the butanol initiated polyalkylene glycol-containing compositions of the present invention (Table I, Examples 1, 2, 3 and 6) passed the test and maintained their fire resistance for a time period of at least three times longer than the comparison polyol-ester type fluid (24 hours on average versus less than 8 hours on average for the comparison fluid in the pump test). This is based on periodic sampling of the two fluids during ASTM D2882 pump testing. It must be noted that the equipment used as part of this pump stand includes a pressure control valve thus creating an extreme shear condition, the degree of which is not experienced in normal field service. It is also noted that this fire resistance test was also performed on an analogous formulation to that described above, but replacing the butanol-initiated polypropylene glycol with a polypropylene glycol diol (Table I, Example 4). This analogous formulation also passed the fire resistance test.

It is also noted that this fire resistance test was also performed on analogous formulations to that described above, but replacing the butanol-initiated polypropylene glycol with a nonylphenol-initiated polypropylene glycol (Table I, Example 5). This analogous formulation also passed the fire resistance test. Note that comparative examples (Table II, Comparative Formulations) which contained no anti-mist additives failed the fire resistance test. It should also be noted that antioxidant selection or concentration does not cause the formulation to pass the fire resistance test. Although not tested, base fluids other than polyalkylene glycols may be expected to pass the fire resistance test provided those base fluids have a flash point above 400° F. Examples of alternative base fluids include, but are not limited to, esters, diesters, polyol esters and polyalkylene glycol esters. Esters are the reaction product of an alcohol with an acid. Esters suitable for use as base fluids include esters of polyols and of $C_4$ to $C_{24}$ straight or branched chained monocarboxylic acids. These compounds are prepared by reacting a polyol such as pentaerythritol, dipentaerythritol, tripentaerythritol, trimethylol propane, trimethylol ethane, trimethylol butane, neopentylglycol, glycerol, propylene oxide adducts and/or ethylene oxide adducts of the above polyols and the like with carboxylic acids such as butyric acid, valeric acid, isovaleric acid, caproic acid, hexanoic acid, caprylic acid, pelargonic acid, capric acid, lauric acid, stearic acid, oleic acid, etc. polyalkylene glycol esters include the reaction products of butanol or other mono alcohol initiated propylene oxide and/or ethylene oxide adducts with the above mentioned carboxylic acids or poly functional carboxylic acids, for example, malonic acid, succinic acid, adipic acid, subonic acid, phthalic acid, etc. or poly functional alcohol initiated propylene oxide and/or ethylene oxide adducts, for example, diols, triols tetrols, and the like, reacted with the above-mentioned carboxylic mono acids.

The fluids were also analyzed by GPC in order to determine the loss in molecular weight of the anti-mist additive utilized in the present invention as compared to the additive utilized in the comparison fluid. The additive of the present invention did decrease in molecular weight with time in the pump but did not change significantly in concentration in the hydraulic fluid formulation over time. In contrast, the comparison fluid suffered a decrease both in molecular weight and in concentration in the comparison hydraulic fluid over time in the pump during the period of the pump test.

While the invention has been described above with reference to a specific embodiment thereof, it is apparent that many changes, modifications and variations can be made without departing from the inventive concept disclosed. Accordingly, it is intended to embrace all such changes, modifications and variations that fall within the spirit and broad scope of the appended claims. All publications cited herein are incorporated by reference in their entirety.

What is claimed is:

1. A process for imparting flame retardancy and reduced wear characteristics to a hydraulic system which comprises adding to the hydraulic system a hydraulic fluid composition comprising:

(a) a synthetic base fluid having a flash point of at least 400° F. selected from the group consisting of polyalkylene glycol esters, polyalkylene glycols, and combinations thereof, and (b) as an anti-mist additive, an alkylene-vinyl ester copolymer having a molecular weight of between about 5,000 and about 100,000 and soluble in said base fluid, wherein the ratio of alkylene groups to vinyl ester groups in the copolymer is between about 1:10 and about 10:1, and wherein said anti-mist additive is present in an amount of between about 0.1 and about 20 weight percent based upon the total amount of anti-mist additive plus base fluid in the composition.

2. The process of claim 1 wherein said base fluid is selected from the group consisting of polyethylene glycol, polypropylene-glycol, polybutylene glycol, and combinations thereof.

3. The process of claim 1 wherein said alkylene-vinyl ester copolymer employs alkylene moieties selected from the group consisting of ethylene, propylene, butylene, and combinations thereof.

4. The process of claim 1 wherein said polyalkylene glycol base fluid is a lower alkanol-started polyalkylene glycol.

* * * * *